US009124996B2

(12) United States Patent
Nelson et al.

(10) Patent No.: US 9,124,996 B2
(45) Date of Patent: Sep. 1, 2015

(54) APPARATUS AND METHOD FOR REPRODUCING A SOUND FIELD WITH A LOUDSPEAKER ARRAY CONTROLLED VIA A CONTROL VOLUME

(75) Inventors: Philip Nelson, Romsey (GB); Filippo Maria Fazi, Bolzano (IT); Jeongil Seo, Daejeon (KR); Kyeongok Kang, Daejeon (KR)

(73) Assignees: UNIVERSITY OF SOUTHAMPTON, Southampton (GB); ELECTRONICS & TELECOMMUNICATIONS RESEARCH INSTITUTE OF KOREA, Taejon (KR)

( * ) Notice: Subject to any disclaimer, the term of this patent is extended or adjusted under 35 U.S.C. 154(b) by 869 days.

(21) Appl. No.: 13/122,252

(22) PCT Filed: Oct. 1, 2009

(86) PCT No.: PCT/GB2009/051292

§ 371 (c)(1),
(2), (4) Date: Jul. 15, 2011

(87) PCT Pub. No.: WO2010/038075

PCT Pub. Date: Apr. 8, 2010

(65) Prior Publication Data

US 2011/0261973 A1 Oct. 27, 2011

(30) Foreign Application Priority Data

Oct. 1, 2008 (GB) ..... 0817950.9

(51) Int. Cl.
*H04R 5/00* (2006.01)
*H04S 3/00* (2006.01)

(52) U.S. Cl.
CPC ..... *H04S 3/00* (2013.01); *H04S 2420/11* (2013.01); *H04S 2420/13* (2013.01)

(58) Field of Classification Search
None
See application file for complete search history.

(56) References Cited

U.S. PATENT DOCUMENTS

2008/0101620 A1* 5/2008 Horbach et al. ..... 381/59
2008/0201138 A1* 8/2008 Visser et al. ..... 704/227
2009/0034764 A1* 2/2009 Ohashi ..... 381/307

FOREIGN PATENT DOCUMENTS

WO WO2006/096959 * 9/2006
WO 2010038075 A2 4/2010
WO 2010038075 A3 8/2010

OTHER PUBLICATIONS

International Preliminary Report on Patentability for International Application No. PCT/GB20091051292, dated Apr. 5, 2011 (7 pages).

(Continued)

*Primary Examiner* — Joseph Saunders, Jr.
*Assistant Examiner* — James Mooney
(74) *Attorney, Agent, or Firm* — Tillman Wright, PLLC; James D. Wright; David R. Higgins

(57) ABSTRACT

Method and, apparatus for implementing the method, the method comprising determining control signal data for an array of loudspeakers, the control signal data being such as to control the loudspeakers to produce a desired sound field associated with an audio signal, the method comprises determining control signal data for different frequency components of the desired sound field in respect of respective different positions in a listening volume of the loudspeaker array, wherein determination of the control signal data comprises sampling the desired sound field at the surface of a control volume (V).

18 Claims, 6 Drawing Sheets

(56) References Cited

OTHER PUBLICATIONS

Epain et al., "Active control of sound inside a sphere via control of the acoustic pressure at the boundary surface", Journal of Sound & Vibration, London, GB, LNKD-DOI:10. 1016/ J.JSV., 2006-06.66, vol. 299, No. 3, Oct. 28, 2006, pp. 587-604, XP005735484. ISSN: 0022-460X, p. 588-593; figures 2, 3, 9, 11, p. 602-603.

Gauthier, P., Berry, A., "Adaptive Wave Field Synthesis for Sound Field Reproduction: Theory, Experiments and Future Perspectives". AES 123rd Convention Paper, 7300, Oct. 8, 2007, XP002586616, New York, p. 2-12; figures 1, 2. 12, 13, p. 17-19.

Nelson, P., Yoon, S., "Estimation of Acoustic Source Strength by Inverse Methods: Part I, Conditioning of the Inverse Problem", Journal of Sound and Vibration, vol. 233, No. 4, Jan. 1, 2000, pp. 643-668, XP002586618 DOI: doi: 10.1006/jsvi. 1999.2837, the whole document.

Gover, B. et al., "Microphone array measurement system for analysis of directional and spatial variations of sound fields", The Journal of the Acoustical Society of America, American Institute of Physics for the Acoustical Society of America, New York, NY, US. LNKD-DOI:10.1121/1.1508782, vol. 112, No. 5, Nov. 1, 2002, pp. 1980-1991, XP012003132 ISSN: 0001-4966, the whole document.

Parthy, A., Jin, C., Van Schaik, A., "Optimisation of Co-centered Rigid and Open Spherical Microphone Arrays". AES 120th Convention, 6764, May 23, 2006, XP002586617, Paris, p. 1-2.

Gauther, P. et al., "Sound-field reproduction in-room using optimal control techniques: Simulations in the frequency domain a)". The Journal of the Acoustical Society of America, American Institute of Physics for the Acoustical Society of America, New York, NY, US, LNKD- DOI: 10.1121/1.1850032, vol. 117, No. 2, Feb. 1, 2005, pp. 662-678, XP012072769, ISSN: 0001-4966, p. 664-665, figures 1, 2, 17, 18, p. 671-677.

Spors, S. et al., "The Theory of Wave Field Synthesis Revisited" Audio Engineering Society (AES) Convention Paper, New York, NY, US, vol. 124, May 17, 2008, p. 19PP, XP007910177, the whole document.

Buchner, H. et al., "Wave-domain adaptive filtering:acoustic echo cancellation for full-duplex systems based on wave-field synthesis" Acoustics, Speech, and Signal Processing, 2004. Proceedings. (ICASSP '04). IEEE International Conference on Montreal, Quebec, Canada, May 17-24, 2004, Piscataway, NJ, US, IEEE LNKD-DOI: 10.1109/ICASSP.2004.1326777, vol. 4, May 17, 2004, pp. 117-120, XP010718419, ISBN:978-0-7803-8484-2, pp. 119-120; figures 1, 2, 4.

* cited by examiner

APPARATUS AND METHOD FOR REPRODUCING A SOUND FIELD WITH A LOUDSPEAKER ARRAY CONTROLLED VIA A CONTROL VOLUME

CROSS REFERENCE TO RELATED APPLICATIONS

This application is the U.S. national stage application under 35 U.S.C. §371 of co-pending International Application No. PCT/GB2009/051292, filed Oct. 1, 2009 and designating the U.S., which published as WO 2010/038075 A2 on Apr. 8, 2010, and which claims the benefit of Great Britain Application Serial No. 0817950.9, filed Oct. 1, 2008. Each of the foregoing patent applications and patent application publications are expressly incorporated herein by reference in their entireties.

TECHNICAL FIELD

The present invention relates to an apparatus and method for sound reproduction.

BACKGROUND

In the prior art, systems are known for the recording and the reproduction of sound. Such systems provide, with an array of loudspeakers, the physical reconstruction of a desired sound field over a region of space. The sound field generated by the loudspeakers should give to the listeners located in the listening area the realistic perception of a desired virtual sound source or of a virtual sound scene.

One well known technology of this kind is Wave Field Synthesis disclosed in patent applications US 2006/0098830 A1, WO2007/101498 A1, US 2005/0175197 A1, US 2006/0109992 A1, for example. The technology uses the Kirchhoff Helmholtz equation which implies, in theory, the use of both dipole-like and monopole-like secondary sources (the loudspeakers), the strength of which (that are proportional to the loudspeaker signals) is explicitly given by the value of the sound field on the integration contour and its normal derivative, respectively.

Another known technology is Ambisonics, for example as disclosed in U.S. Pat. No. 5,757,927—1998, High Order Ambisonics as disclosed in US 2006/0045275 A1 and another technology disclosed in US 2005/0141728 A1. The theoretical formulation of these methods involve a large use of cylindrical or spherical harmonics and Legendre polynomials, in the same way that the use of sines and cosines or complex exponentials arise in the theoretical formulation of any technology based on the traditional Fourier transform. These prior art technologies involve the use of a matrix-based processing to encode the recorded signals and generate an intermediate format, and a matrix-based system to decode this intermediate format and generate the driving signals for the loudspeakers.

We seek to provide an improved apparatus and method for reproduction of sound.

SUMMARY

According to one aspect of the invention there is provided a method of determining control signal data for an array of loudspeakers, the control signal data being such as to control the loudspeakers to produce a desired sound field associated with an audio signal, the method comprises determining control signal data for different frequency components of the desired sound field in respect of respective different positions in a listening volume of the loudspeaker array, wherein determination of the control signal data comprises sampling the desired sound field at the surface of a control volume.

According to another aspect of the invention there is provided sound reproduction apparatus for processing an audio signal, the apparatus configured to output control signal data for an array of loudspeakers to produce a desired sound field associated with the audio signal, wherein the apparatus configured to determine the control signal data for different frequency components of the desired sound field in respect of respective different positions in a listening volume of the loudspeaker array, wherein determination of the control signal data comprises sampling the desired sound field at the surface of a control volume.

A further aspect of the invention relates to a signal processor configured to process the audio signal of the above aspects of the invention and output the control signal data. The signal processor may be configured by suitable machine-readable instructions, and the instructions may be realised in the form of a signal or a data carrier device.

BRIEF DESCRIPTION OF THE DRAWINGS

Various embodiments of the invention will now be described by way of example only, with reference to the following drawings in which.

DETAILED DESCRIPTION

Figure 1:
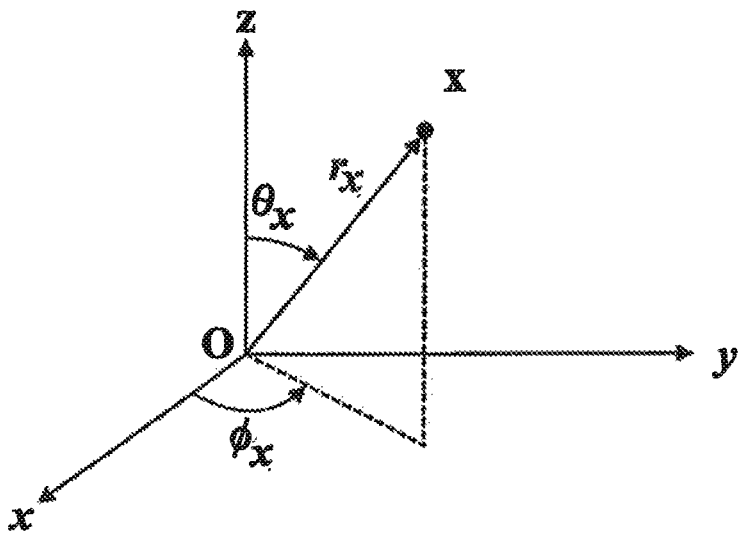
FIG. 1 shows a co-ordinate system.

The theoretical background on which the inventive apparatus is based is as follows. The signals driving the array of loudspeakers are designed to be such that the difference (more specifically the $L^2$ norm of the difference) between the desired or target sound field and the sound field generated by the array of loudspeakers is minimized on the surface of a three dimensional region, herein called the control volume. The problem is formulated mathematically as an integral equation of the first kind, and its solution is used in order to suitably configure the signal processing apparatus embedded in the system. The solution of the integral equation is often an approximated solution because of the mathematical ill-posedness of the problem. As described in detail below, the solution of the integral equation can be computed either with an analytical approach or with a numerical method. The two cases define two different approaches for the design of the signal processing apparatus. Both methods are described in this application. An aspect of the below described embodiments is that different choices of some parameters and/or solution methods are chosen depending on the frequency of the sound to be reproduced.

When the integral equation is solved with a numerical method, the latter requires that the target sound field is defined at a finite number of points on the boundary of the control volume, which is therefore sampled. The numerical solution of the integral equation is influenced by two sources of error: one due to ill-conditioning and one due to spatial aliasing. The former is more likely to affect the performance of the system at low frequencies, while the latter degrades the performance at high frequencies. These undesired effects can be avoided or contained by a wise choice of the control volume and of the sampling scheme used on the boundary of the control volume. It can be shown that at low frequencies the effects of ill-conditioning can be limited by choosing a large control volume. On the other hand the effects of the spatial aliasing can be reduced by choosing a regular sampling scheme of the surface of the control volume, for which the average distance between any two neighboring sampling points is less than half of the wavelength considered. For this reason, we define a control volume which is a function of the frequency of the sound to be reproduced: a large control volume at low frequencies and a gradually smaller control volume for higher frequencies. Even though the size of the control volume varies with the frequency its shape does not vary, and the number and geometrical arrangement of the samples of the boundary of that region generally does not vary, but in some cases it may be advantageous to allow such a variation. This approach allows the definition, for each frequency, of a control volume which is large enough to avoid the problems arising from ill-conditioning, keeping at the same time the distance between neighboring sampling points below the spatial aliasing limit.

A further aspect of the embodiments below relate to the solution of problems which can arise at certain frequencies that correspond to the so-called Dirichlet eigenvalues of the control volume. These problems arise when an attempt is made to reconstruct a sound field which is defined, at those frequencies, only on the boundary of the control volume. These critical frequencies are determined by the shape and size of the control volume. Our choice of a frequency dependent control volume has been applied to overcome these difficulties. In addition to that, we have chosen to define or measure the sound field at one or more locations in the interior of the control volume. In the design of the microphone array discussed below, when the microphones are arranged on spherical layers, we have chosen to include a microphone also in the centre of the microphone array. This choice has proven to overcome the problems due to the first critical frequency.

Another aspect of the embodiments below is related to the reproduction of a high frequency sound field due to a point source at a given location. In this case the approach used at low frequencies would lead all or almost all the loudspeakers of the array to contribute to the reproduced sound field. They would generate a large amount of acoustic energy, and the sound fields due to the different loudspeakers would generate a complex pattern of destructive and constructive interferences which would reconstruct the target field just over a limited region of the space. We have observed that the digital filters, which are part of the signal processing apparatus and correspond to those loudspeakers which are closer to the location of the virtual source, exhibit an asymptotic behavior at high frequencies. The amplitude of these filters tends to be constant and their phase tends to become linear. This fact has been proven mathematically in the special case when the loudspeakers are regularly arranged on the surface of a sphere, but similar conclusions can be inferred also for other geometric arrangements. For this reason, for the Single Input Mode described below, the processing applied to a high frequency component of the audio signal is different than that applied to the low frequency component of the signal. For the high frequency processing, only the loudspeakers which are the closest to the location of the virtual source are activated, and the corresponding digital filters have been substituted with simple gains, which resemble the asymptotic behavior of those filters. The Single Input Mode of the system may be viewed as a hybrid of a sound field reconstruction system and a three dimensional sound panning system. This approach has multiple advantages: in the first place, the amount of acoustic energy generated by the system is reduced. As a second instance, the real time calculation of the gains is computationally considerably less expansive than the real time calculation of an equivalent number of digital filters. Finally, the fact that only the loudspeaker, or those loudspeakers, close to the virtual source location are activated provides better cues at high frequencies for the human localization of a virtual sound source.

An especially innovative aspect of the embodiments described below is that the control volume can be chosen to be dependent on the frequency of the sound to be reproduced, and different processing steps are in general applied to the signals at different frequency bands. It is also worthwhile mentioning that the recording devices and reproduction devices of this system are designed to operate as a unique system, and there is no intermediate audio format on which the information between the recording part and the reproduction part of the system is transmitted. Finally, a further innovative feature of this invention is constituted by the Auralisation Mode (and the Auralisation Processing Unit), which allows to apply the theory of the reconstruction of a sound field to the design of a multi-channel reverberation simulator.

The principles described above have been applied to the design of the different components which constitute the signal processor apparatus of the sound reproduction system. The signal processor apparatus can be used to generate sound fields of three different characteristics:

1. A sound field generated in the free field by a virtual point source, whose location in the space and whose radiation pattern are selected.
2. A sound field generated by an omnidirectional point source in a reverberant environment, whose reverberant field is described by a set of measured or simulated impulse responses.
3. A generic sound field, described by a set of recorded sound signals acquired using a microphone array.

These three different characterizations define three different operating modes for the system, which are here defined as the Single Input Mode, the Auralisation Mode and the Multiple Input Mode, respectively. The general layout of the sound reproduction system comprises sound recording devices, modular signal processors and an array of loudspeakers (and their associated amplifiers). While the loudspeaker array is the same for the three different operational modes, the input devices and the signal processing are different for each of the modes.

In the Single Input Mode, the input signal is a single audio signal. The latter is obtained by capturing with a microphone the sound field generated by a sound source in an anechoic environment, or alternatively in a moderately reverberant environment, with the microphone located at a short distance from the source of sound. Additional data are provided, which describe the location of the virtual source (azimuth, elevation and distance) and preferably its radiation pattern as a function of two angles and of the frequency. The signal is digitally processed by the Single Channel Processing Unit, which is described in detail below. The location of the virtual source can be within or outside the loudspeaker array, but always outside of the control volume.

In the Multiple Input Mode, the input is a set of audio signals acquired with an array of microphones, designed for this purpose. The signals are processed by the Multiple Input Processing Unit, which is described in detail later and which is constituted by a matrix of digital filters. These are computed from a set of impulse responses describing the transfer function between each loudspeaker of the loudspeaker array and each microphone of the microphone array. These impulse responses can be either measured or computed from a theoretical model.

In the Auralisation mode the input signal is the same as for the Single Input Mode (a single anechoic audio signal), while the signal is digitally processed by the Auralisation Processing Unit described later. The latter is constituted by a set of digital filters, which are computed from two sets of impulse responses. The first set is constituted by the impulse responses of the considered reverberant environment measured with a specially designed microphone array. The second set of impulse responses is the same as that described for the Multiple Input Mode (describing the transfer functions between loudspeakers and microphones of the two arrays).

There is no a priori constraint on the loudspeaker arrangement, apart from the mild constraint that they should be arranged on a three dimensional surface, which surrounds the listening area and their axes are pointed towards the geometrical centre of the array. However, the system gives the best performance when a relatively large number of loudspeakers (eight or more) is used, they exhibit a preferably omnidirectional radiation pattern and they are regularly arranged on the surface of a sphere or of a hemisphere. Regular arrangement means here that the average distance between any two neighboring loudspeakers is constant or almost constant.

An example is now given to highlight the differences between the multiple input mode and the auralisation mode. One desires to reproduce the effect of the sound field generated by a violin playing in a concert hall (which is a reverberant environment). One can either 1. Use multiple input mode by recording the violin playing in the hall with the microphone array and then use the output of the microphone array as the input to the Multiple Input Processing Unit. The information on the sound of the violin and on the reverberant field of the hall are captured at the same time by the array and cannot, in principle, be divided, or 2 Use the auralisation mode by recording with the microphone array a set of impulse responses describing the reverberant field of the hall considered. These measurements do not depend on the sound of the violin and are used to calculate the digital filters in the Auralisation Processing Unit. Then one records the violin playing in an anechoic environment (an artificial non-reverberant environment, without reflections) and then use that single audio signal as the input to the Auralisation Processing Unit. The information on the sound of the violin and on the reverberant filed of the hall are captured separately.

In summary, the input to the multiple input unit are the signals from the microphone array. No assumption regarding the form of the field is made and the reverberant characteristic of the hall is not involved on the calculation of the digital filters. They are computed only from the knowledge of the characteristics of the microphone array and of the loudspeaker array geometry.

On the other hand, the input to the Auralisation Processing unit is a single audio signal (the sound of the violin playing in a non-reverberant environment). The reverberant characteristics of the hall considered, represented by a set of impulse responses, are this time involved in the calculation of the digital filters of the Auralisation Processing Unit.

While the reverberant field and the sound of the violin are captured together for the Multiple Input Mode, they are in the Auralisation Mode captured with separate procedures and are artificially merged by the auralisation processing unit.

The Multiple Input Mode has the advantage of capturing and reproducing a natural and real sound of an acoustic source in a given reverberant or non-reverberant environment.

The Auralisation mode has the advantage that the reverberant characteristic of the room and the sound from the given acoustic source are acquired separately and merged together later. With the Auralisation mode, it is possible to use the same reverberant hall and to change the sound source (for example a violin, a piano etc playing in a given concert hall) or conversely to use the same source of direct sound (the violin) and change the reverberant environment (with the artificial effect of having the same musician playing his/her violin in different concert halls).

FIGS. 7*a* to 7*d* show microphone array 100 comprising a framework for supporting a set of thirty microphones. The array is designed to be used for the auralisation mode, for measuring the impulse responses of the reverberant environment to be emulated. The framework comprises two substructures 110 and 120 of substantially arcuate form. The substructure 110 comprises two spaced apart arcuate members 112 and 113 connected by a bridging member 114. The substructure 120 comprises two spaced apart members 122 and 123, the spaced apart members connected by a bridging member 124. Each of the substructures is disposed at different radii 121 and 122 from a centre point. The substructures 110 and 120 are pivotably mounted about a pole 150. Apertures 140 are provided in the arcuate members and the bridging members and are dimensioned to locate the microphone devices (not illustrated). A removable rigid sphere 160 is located inside the array. It is to be noticed that the two layers of microphones do not extend over a entire sphere but extend only over sectors. For this reason, the measurement of the impulse responses must be repeated eight times. At each measurement, thirty signals are acquired by the thirty microphones. After each measurement step, the array is rotated of 45° around its vertical axis. The eight measurements allow one to obtain a set of two hundred and forty impulses, captured at locations corresponding to an approximately regular sampling of two concentric spherical surfaces. Because the two hundred and forty signals can not be captured at the same time, this microphone configuration can be used for the auralisation mode only and not for the multiple input mode, for which the microphone signals should be acquired simultaneously.

Theoretical Analysis

Figure 2:
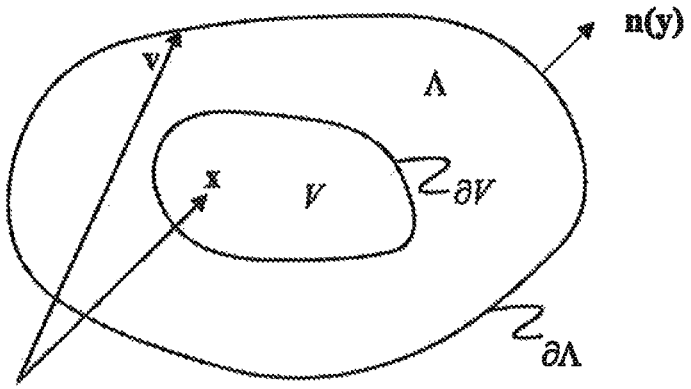
FIG. 2 shows of different three-dimensional regions.

In what follows, vectors are represented by lower case bold letters. The convention for the spherical co-ordinates $r_x$, $\theta_x$, $\phi_x$ of a given vector x is illustrated in FIG. 1. Matrices are represented by capital bold letters. The imaginary unit is given by $i=\sqrt{-1}$. The symbol $[\bullet]^*$ represents the complex conjugate and the symbol $[\bullet]^H$ represents the Hermitian transpose (or conjugate transpose) of a matrix. $\delta_{nm}$ is the Kronecker delta ($\delta=1$ if $n=m$, $\delta_{nm}=0$ if $n\neq m$). Let $V\subseteq R^3$ be a bounded and simply connected volume of the three dimensional space, with boundary a $\partial V$ (of class $C^2$). A cross section of this volume is represented in FIG. 2. This region is referred to as the control volume. The assumption is made that the target sound field p(x,t) is due to sources of sound that are not contained in V, and that no scattering object is contained within this region. p(x,t) satisfies the homogeneous wave equation $$\nabla^2 p(x, t) - \frac{1}{c^2}\frac{\partial^2 p(x, t)}{\partial t^2} = 0 \quad (1)$$

in V, where c is the speed of sound, considered to be uniform in V. When a single frequency ω is considered and $p(x,t)=\mathrm{Re}\{p(x)e^{-i\omega t}\}$, equation (1) can be reformulated as the Helmholtz equation $$\nabla^2 p(x)+k^2 p(x)=0$$

$$x\in V \quad (2)$$

where $k=\omega/c$ is the wave number and the time dependence $e^{-i\omega t}$ has been omitted. Let now $A\subseteq R^3$ be a bounded and simply connected region of the space, with boundary ∂Λ of class $C^2$, that fully encloses V. Assume now that a continuous distribution of an infinite number of secondary, monopole-like sources is arranged on the boundary ∂Λ. This continuous distribution of secondary sources is the ideal model of the loudspeaker array, which is useful for the mathematical formulation of the problem. Later on the assumption that the number of secondary sources is infinite will be removed.

The assumption is made that the sound field $p_y(x)$ generated by the secondary source located at y∈∂Λ can be represented by a Green function G(x|y), thus satisfying the inhomogeneous Helmholtz equation $$\nabla^2 p_y(x)+k^2 p_y(x)=-a(y)\delta(x-y)$$

$$x\in\overline{V},\ y\in\partial\Lambda \quad (3)$$

where the function a(y) represents the complex strength of the secondary sources. In a free field, $p_y(x)$ can be represented by the free field Green function $$p_y(x) = a(y)g(x\mid y) = a(y)\frac{e^{ik|y-x|}}{4\pi|y-x|} \quad (4)$$

$$x\in R^3,\ y\in\partial\Lambda$$

In a reverberant environment, the Green function has a more complex expression, which strongly depends on the shape of the reverberant enclosure and on its impedance boundary conditions.

The sound field $\hat{p}(x)$ generated by the infinite number of secondary sources uniformly arranged on ∂Λ can be expressed as an integral, representing the linear superposition of the sound fields generated by the single sources:

$$\hat{p}(x)=(Sa)(x)=\int_{\partial\Lambda} G(x|y)a(y)dS(y)$$

$$x\in V \quad (5)$$

In what follows, $\hat{p}(x)$ is also referred to as the reconstructed or reproduced sound field, while the integral introduced is often referred to as a single layer potential and a(y) is called the density of the potential.

Let now consider the following differential equation $$\nabla^2 p(x)+k^2 p(x)=0\ x\in V$$

$$p(x)=f(x)\ x\in\partial V \quad (6)$$

where the function f(x) describes the value field p(x) on the boundary ∂V. This differential equation is known as the Dirichlet problem (and the related boundary condition is called after the same name). As the Kichhoff-Helmholtz integral equation suggests, the knowledge of both the sound field and its normal derivative on the boundary (the Cauchy boundary condition) uniquely defines a sound field in the interior region V. However, this condition can be relaxed. In fact, under the above mentioned conditions and with the appropriate regularity assumption on the function f(x), the Dirichlet problem (5) has a unique solution. This implies that the knowledge of the acoustic pressure on the boundary ∂V of the control volume is enough to define completely the sound field in the interior of volume V. This holds as long as the wave number k is not one of the Dirichlet eigenvalues $k_n$. The latter are defined as the infinite and countable wave numbers $k_n$ such that the differential equation (5) with homogeneous boundary conditions f(x)=0 is satisfied.

It is worth mentioning that the sound field in V can be ideally extended by analytical continuation to the exterior of the control volume, provided that the considered region does not contain any source of sound. This implies that if the acoustic field is reconstructed perfectly on the boundary of the control volume V, then it is reconstructed perfectly also in its interior and partially in the neighboring exterior region.

The determination of the density a(y) can be formulated as $$p(x)=(Sa)(x)=\int_{\partial\Lambda} G(x|y)a(y)dS(y)$$

$$x\in\partial V \quad (7)$$

where p(x) is given and the density a(y) is the unknown of the problem. Note that the integral operator (Sa)(x) has been defined here as the restriction of the single layer potential (5) to the boundary ∂V. Equation (7) is an integral equation of the first kind and the determination of a(y) from the knowledge of p(x) on the boundary ∂V represents an inverse problem. It is important to highlight that equation (7) represents a problem that is, in general, ill-posed. This implies that a solution a(y) might not exist, and even if it exists it might be non-unique or not continuously dependent on the data p(x). The latter concept implies that small variations or errors on p(x) can result in very large errors in the solution a(y), which is therefore said to be unstable. It is however always possible to compute an approximate but robust solution by applying a regularization scheme.

It is important to highlight that the integral equation (7) is different from the Kirchhoff-Helmholtz equation (often also called Green formula) on which the technology called Wave Field Synthesis is grounded. The first main difference is that the integrand in the Kirchhoff-Helmholtz equation involves both monopole-like and dipole-like secondary sources, and the expression of their strength is expressed explicitly. On the other hand, the proposed approach relies on the use of monopole-like secondary sources only, and the determination of their strength is determined by the solution of the integral equation. The second main difference is that the field is known on the boundary ∂V, which is not the same as the boundary ∂Λ on which the secondary sources are arranged. This point describes also the main difference between the proposed approach and the Simple Source Formulation. It is possible to choose the control volume as a function of the frequency, while the secondary sources are arranged on the surface ∂Λ which does not depend on the frequency.

It is now possible to seek a solution to equation (7) using two different methods, one based on an analytical approach and the other based on a numerical solution of discretised version of the integral. As described above, the solution of the integral is applied to the design the signal processing unit embedded in the proposed system. In order to do that, the continuous solution provided by the analytical approach needs to be slightly modified in order to be adapted to the finite number of loudspeakers. The number of loudspeakers is L and the position of the acoustic centre of the l-th loudspeaker is identified by the vector $y_l$.

Analytical Solution of the Integral Equation

The first method to calculate a solution to equation (7) is an analytical method based on the singular value decomposition of the integral operator and is described in what follows.

To begin with, the scalar product of two square integrable functions f(y) and g(y), with the same domain D, is here defined as $$\langle f|g\rangle = \int_D f(x)^* g(x)\,dS(x) \tag{8}$$

The adjoint operator $S^+$ of S is defined to be such that $$\langle g|Sa\rangle = \langle S^+ g|a\rangle \tag{9}$$

It can be easily verified that, for the operator S introduced in equation (7), the adjoint operator $S^+$ is given by $$(S^+g)(y) = \int_{\partial V} G(y|x)^* g(x)\,dS(x)$$

$$y \in \partial\Lambda \tag{10}$$

The physical meaning of the single layer potential (Sa)(x) is represented by the sound field generated by the continuous distribution of secondary sources on ∂Λ, evaluated at x∈∂V. Similarly, its adjoint operator $(S^+g)(y)$ can be regarded as the time reversed version of the sound field generated by a continuous distribution of monopole-like secondary sources on ∂V, evaluated at y∈∂Λ. The time reversal is due to the fact that the kernel of the integral (10) is the complex conjugate of the Green function G(y|x). Considering, as an example, the case of the free field Green function g(x|y) introduced in equation (4), it can be easily verified that g(y|x) and g(y|x)* differ because of the sign of the exponential. This implies that while g(•|x) can be considered as the representation of a sound field generated by a source of outgoing (diverging) spherical waves located at x, g(•|x)* could be understood as the case of a source of incoming (converging) spherical waves located at the same position x. Alternatively, the sound field represented by g(ω|x)* could be regarded as the time reversed version of g(•|x), as $$\mathrm{Re}\{e^{-i\omega t} g(x\,|\,y)^*\} = \mathrm{Re}\left\{\frac{e^{-i(k|x-y|+\omega(-t))}}{4\pi|x-y|}\right\} = \mathrm{Re}\{e^{-i\omega(-t)} g(x\,|\,y)\} \tag{11}$$

For both interpretations, the generated spherical wave fronts are converging towards x. As a consequence of what has been said, the adjoint operator $S^+$ could be interpreted as a continuous distribution of "sources of incoming waves" on ∂V. It can be shown that the operator S is compact and therefore its adjoint operator is compact too and the composite operator $S^+S$ is compact and self-adjoint. It is therefore possible to apply the properties of compact self adjoint operators and to perform a spectral decomposition of $S^+S$. As a first step, the set of functions $a_n$ (y) is computed, these functions being solutions of the eigenvalue problem $$(S^+Sa_n)(y) = \lambda_n a_n(y)$$

$$y \in \partial\Lambda,\ n = 1,2,3 \ldots \infty \tag{12}$$

where the eigenvalues $\lambda_n$ are real, positive numbers. Considering the interpretation of S and $S^+$ introduced above, the effect of the composite operator $(S^+Sa)(y)$ could be understood as follows: a sound field is generated by the continuous distribution of monopole-like sources on ∂Λ with strength a(y), and this field, on the boundary ∂V, is described by the function $\hat{p}(x)$. Mathematically this implies that $\hat{p}(x)=(Sa)(x)$. A different sound field is then generated by a continuous distribution of monopole-like sources on ∂V (the operator $S^+$), and the strength of the sources is determined by the function $\hat{p}(x)$. The sound field is then time reversed (or alternatively the secondary sources on ∂V can be replaced by "sources of incoming waves"), and the function $\hat{a}(y)$ describes the value of this field on ∂Λ. In mathematical terms, this corresponds to $\hat{a}(y)=(S^+\hat{p})(y)$. Summarizing, the effect of the operator $S^+S$ can be understood as if the field generated by the secondary sources on ∂Λ was propagated from ∂Λ to ∂V and then propagated back to ∂Λ. Attention is now focused on the relation between $\hat{a}(y)$ and a(y): if these two functions are such that $\hat{a}(y)=\lambda_n a(y)$, $\lambda_n \in R^+$, then the function a(y) is one of the eigenfunctions $a_n(y)$ of $S^+S$, and is a solution of (12). This means that the action of $S^+S$ on $a_n(y)$ is simply an amplification or attenuation of the function, corresponding to positive real number $\lambda_n$.

The set of functions $a_n(y)$ constitutes an orthogonal set of functions for ∂Λ meaning that any square integrable function a(y) defined on ∂Λ can be expressed as $$a(y) = \sum_{n=1}^{N} \langle a_n\,|\,a\rangle a_n(y) + (Qa)(y) \tag{13}$$

The integer N depends on the dimension of the range of S and might be infinite. (Qa)(y) is the orthogonal projection of a(y) on the null-space of S. The latter is defined as the set of functions $\tilde{a}(y)$ such that $$N(S) = \{\tilde{a}(y) : (S\tilde{a})(x) = 0\} \tag{14}$$

If this set is empty, then the set of functions $a_n(y)$ is complete and equation (13) can be regarded as a generalized Fourier series. We can also generate a set of orthogonal functions $p_n(x)$ on ∂V by letting the operator S act on the functions $a_n$ (y) such that $$\sigma_n p_n(x) = (Sa_n)\ n = 1,2,3, \ldots \infty \tag{15}$$

where the positive real numbers $\sigma_n = \sqrt{\lambda_n}$ are the singular values of S. It can be also proved that $$\sigma_n a_n(x) = (S^+ p_n)\ n = 1,2,3, \ldots \infty \tag{16}$$

It is possible to express any square integrable function p(x) on ∂V as the infinite series $$p(x) = \sum_{n=1}^{N} \langle p_n\,|\,p\rangle p_n(x) + (Rp)(x) \tag{17}$$

(Rp)(x) being the orthogonal projection of p(x) on the null-space of $S^+$. Combining equations (13) and (15) and keeping in mind that (S(Qa))(x)=0 because of the definition of the null-space (14), it is possible to express the action of S on a(y) as $$(Sa)(x) = \sum_{n=1}^{N} \sigma_n \langle a_n\,|\,a\rangle p_n(x) = \hat{p}(x) \tag{18}$$

$$x \in \partial V$$

It is now possible to calculate an approximate solution of the integral equation (7) as $$a(y) = \sum_{n=1}^{N} \frac{1}{\sigma_n} \langle p_n \mid p \rangle a_n(y) \tag{19}$$

This equation provides a very powerful method for solving the problem of sound field reproduction with a continuous layer of monopole-like secondary sources. In fact, considering equations (15), (17) and (19), the single layer potential with the density computed in equation (18) is given by $$\begin{aligned} \int_{\partial\Lambda} G(x \mid y) a(y) dS(y) &= \int_{\partial\Lambda} G(x \mid y) \left( \sum_{n=1}^{N} \frac{1}{\sigma_n} \langle p_n \mid p \rangle a_n(y) \right) dS(y) = \\ &= \sum_{n=1}^{N} \frac{1}{\sigma_n} \langle p_n \mid p \rangle (Sa_n)(x) \\ &= \sum_{n=1}^{N} \langle p_n \mid p \rangle p_n(x) \\ &= p(x) - (Rp)(x) \\ &= \hat{p}(x) \end{aligned} \tag{20}$$

This implies that the reconstructed sound field $\hat{p}(x)$ is the component of the target field that does not belong to the null-space of the adjoint operator $S^+$, or equivalently that $\hat{p}(x)$ is the projection of $p(x)$ on the sub-space defined by the range of S. In other words, with the usual condition on the Dirichlet eigenvalues, if the target field has a pressure profile $p(x)$ on $\partial V$ that can be expressed as a linear combination of the orthogonal functions $p_n(x)$, then it is ideally possible to determine a density $a(y)$ such that $\hat{p}(x)=p(x)$ in V. In the case when $p(x)$ is not in the range of S, it can be shown that the reconstructed field $\hat{p}(x)$ in (20) is the function that belongs to the range of S that minimizes the $L^2$ norm of the difference $\|p(x)-\hat{p}(x)\|_{L^2}$ on $\partial V$.

Considering equation (16), it can be noticed that even if some of the functions $p_n(x)$ do not rigorously belong to the null-space of $S^+$, their related singular value $\sigma_n$ can be so small that it is possible to consider these $p_n(x)$ as if $(S^+p_n)(x)\approx 0$. This sheds some light on the ill-conditioning of the inverse problem represented by the integral equation (7). In fact, if for a given n the corresponding singular value $\sigma_n$ is very small, then its reciprocal is very large and the norm of the density $a(y)$ computed with the series (19) might become unreasonably large. Furthermore, the factor $1/\sigma_n$ is related to the amplification of errors contained in the data $p(x)$ and therefore to the stability of the system. In order to prevent this ill-conditioning problem, it is possible to regularize the solution (19), applying a cut-off to the spectrum of the operator, using the Tikhonov regularization or any other regularization technique. In the design of the digital filters used in the system described in this application, a combination of spectral cut-off and Tikhonov regularization is used and the application of this is described later.

It has been shown that the possibility of calculating a density $a(y)$ for reconstructing the target sound field $p(x)$ with the single layer potential (5) from the knowledge of the boundary values of $p(x)$ on $\partial V$ is strongly related to the null-space of the adjoint operator $S^+$. It is important to emphasize that if it is not possible to calculate exactly the density $a(y)$, this does not imply that the latter does not exist and that the target sound field can not be perfectly reconstructed by the continuous distribution of secondary sources. An analogous if not identical problem arises in the field of Acoustic Holography: suppose that an attempt is made to determine the surface normal velocity of a radiating plate from the knowledge of the radiated sound field on a given region. It turns out that the vibration modes that generate evanescent waves cannot in practice be determined from far field measurements. However, this does not mean that these low-efficiency vibro-acoustic modes do not exist. This highlights the fact that the feasibility of the reconstruction of the target sound field not only depends on the arrangement $\partial\Lambda$ of the secondary sources, but also is very much related to the surface $\partial V$ on which the sound field has been defined or measured.

This method of solution has the big advantage that the density $a(y)$ has an analytical expression and the design of the digital filters implemented in the system does not require any numerical matrix inversion. However, there are two disadvantages of this method. The first is that the eigenfunctions $a_n(y)$ strongly depend on the geometry of V and $\Lambda$ and their explicit calculation is usually not trivial. Their formulation is known for a limited number of geometries. The second disadvantage is that, when the continuous distribution of secondary sources is substituted by an array of a finite number of loudspeakers, the performance of the system whose signal processing units have been designed with this method are more effective if the distribution of the secondary sources (the loudspeakers) is regular.

As an example, the special case is now considered, where the boundaries of the two volumes V and $\Lambda$ are two concentric spheres, with radius $R_V$ and $R_\Lambda$, respectively. The assumption of a free field is also made here. For the case under consideration the functions $a_n(y)$ and $p_n(x)$ and the singular values $\sigma_n$ can be expressed analytically as $$\begin{aligned} a_n(y) &= \frac{1}{R_\Lambda} Y_n^m(\theta_y, \phi_y) \\ p_n(x) &= \frac{\gamma_n}{R_V} Y_n^m(\theta_x, \phi_x) \\ \sigma_n &= R_\Lambda R_V k |h_n^{(1)}(kR_\Lambda) j_n(kR_V)| \end{aligned} \tag{21}$$

$j_n(\bullet)$ is the spherical Bessel function of order n, $h_n^{(l)}(\bullet)$ is the spherical Hankel function of the first kind and order n. The spherical harmonics $Y_n^m(\theta,\phi)$ are defined as $$Y_n^m(\theta, \phi) = \sqrt{\frac{(2n+1)(n-m)!}{4\pi(n+m)!}} P_n^m(\cos\theta) e^{im\phi} \tag{22}$$

where $P_n^m(\bullet)$ are associated Legendre functions. The factor $\gamma_n$, having unitary norm, is given by $$\gamma_n = i \frac{h_n^{(1)}(kR_\Lambda) j_n(kR_V)}{|h_n^{(1)}(kR_\Lambda) j_n(kR_V)|} \tag{23}$$

and represents a phase shift applied to each spherical harmonic of order n due to the action of S. Equation (21) can be verified by substituting it into equation (12), (15) or (16) and applying the spherical harmonic expansion of the free field Green function (A1) together with the completeness and orthogonality relations of the spherical harmonics, equations (A5) and (A6) respectively.

It can be noticed that the spherical harmonics $Y_n^m(\theta,\phi)$ have two indices, while the singular values $\sigma_n$ have only one index. This is due to the degeneracy of the singular values, and it implies that one eigenspace of dimension (2n+1) is associated with the singular values $\sigma_n$. Hence, for each order n, it is possible to generate a set of (2n+1) orthogonal spherical harmonics which span that subspace. In other words, all the spherical harmonics of order n and degree m are associated with the same singular values $\sigma_n$. This degeneracy is typical of symmetrical geometries (such as the sphere), and arises in many other fields of physics (a well known example in quantum physics is the degeneracy of two electronic configurations, which have the same energy level).

As a result of the orthogonality of the spherical harmonics (A5), it is easy to verify the mutual orthogonality of the set of functions $p_n(x)$ and $a_n(y)$ defined by equation (21). Using the expansion of the free field Green function (A1), it possible to show that the functions $a_n(y)$ and $p_n(x)$ and the singular values $\sigma_n$ satisfy equations (12), (15) and (16).

The spherical wave spectrum $S_{nm}(r)$ of the target sound field p(x), calculated at $r=R_V$, is defined as $$S_{nm}(R_V)=\int_0^{2\pi}d\phi\int_0^{\pi}p(R_V,\theta_x,\phi_x)Y_n^m(\theta,\phi)^*\sin(\theta)d\theta \tag{24}$$

It is now possible to calculate analytically the density a(y) as $$a(y)=\sum_{n=0}^{\infty}\sum_{m=-n}^{n}\frac{Y_n^m(\theta_y,\phi_y)}{R_\Lambda^2 ikh_n^{(1)}(kR_\Lambda)j_n(kR_V)}S_{nm}(R_V) \tag{25}$$

It can be observed that the denominator of (22) equals zero for those wave numbers $k_n$ such that $j_n(k_nR_V)=0$. These wave numbers correspond to the Dirichlet eigenvalues introduced previously, and identify the frequencies of resonance of a spherical cavity with radius $R_V$ and pressure release boundaries (sometimes called the Dirichlet sphere). Under these circumstances, it is not possible to calculate uniquely the density a(y) with (25) because of the non uniqueness of the solution of the Dirichlet problem (6). Considering equation (16), it is easy to notice that the function $Y_n^m(\theta_x,\phi_x)$ belongs to the null-space of $S^+$ and therefore is not in the range of the single layer potential S. Once again, it is important to emphasize that this problem in the reconstruction is not due to the arrangement of the layer of secondary sources on $\partial\Lambda$, but it is due to the boundary $\partial V$ where the target sound field has been defined. For that reason, the density a(y) can be determined by changing the radius of the control volume V.

The determination of the spherical spectrum of the target sound field involves the calculation of the integral (24). For some special cases, this integral can be solved analytically. Considering the expansion of the free field Green function (A1) it is possible to derive the following relation for the spherical spectrum of an omnidirectional point source located at $z>R_V$ (formally a monopole with volume velocity $q_{VOL}=-(i\rho ck)^{-1}$):

$$S_{nm}^{ps}(R_V)=ikh_n^1)(kr_z)j_n(kR_V)Y_n^m(\theta_z,\phi_z)^* \tag{26}$$

It important to emphasize that the source location z should not be in V but can be within $\Lambda$. Considering the spherical harmonic summation formula (A3) and the trigonometric relations (A4), a simplified formula can be derived for the density for the reconstruction of the sound field due to a monopole source:

$$a^{ps}(y)=\sum_{n=0}^{\infty}\frac{h_n^{(1)}(kr_z)}{R_\Lambda^2 h_n^{(1)}(kR_\Lambda)}\frac{2n+1}{4\pi}P_n(\cos(\zeta)) \tag{27}$$

where $P_n(\bullet)$ is the Legendre polynomial of degree n and (see relation (A4))

$$\cos(\zeta)=\frac{y\cdot z}{R_\Lambda r_z}=\sin(\theta_y)\sin(\theta_z)\cos(\phi_y-\phi_z)+\cos(\theta_y)\cos(\theta_z) \tag{28}$$

and represents the cosine of the angle between the vectors y and z. It can be noticed that the summation over the different degrees m has been reduced to the computation of a single Legendre polynomial.

The application of this solution to the design of the signal processing apparatus of the system requires the series (25) and (27) to be truncated to a given order N. Under this assumption, for high operating frequencies such that $kR_\Lambda$, $kr_z>>N$, then the large argument limits or far field approximation (A7) of the spherical Hankel functions and the finite summation formula for Legendre polynomial (A2) can be used in (27), which can be rewritten as $$a^{hf}(y)=\frac{e^{ik(r_z-R_\Lambda)}(N+1)}{R_\Lambda r_z 4\pi}\frac{P_N(\cos(\zeta))-P_{N+1}(\cos(\zeta))}{1-\cos(\zeta)} \tag{29}$$

This is a very powerful formula, which is extremely useful for the real time implementation of a panning function. In fact, the only frequency dependent part of (29) is the complex exponential $e^{ik(r_z-R_\Lambda)}$, and its Fourier transform corresponds in the time domain to a simple delay equal to the distance $r_z-R_\Lambda$. The denominator of (29) is a simple attenuation due to the distance of the point source and the term represented by the series of Legendre polynomials is a gain factor depending on the relative angle between z and y.

In the very special case when the distance of the virtual source $r_z$ equals the sphere radius $R_\Lambda$, equation (27) can be rewritten in the very simple formulation $$a^{real}(y)=\frac{(N+1)}{R_\Lambda^2 4\pi}\frac{P_N(\cos(\zeta))-P_{N+1}(\cos(\zeta))}{1-\cos(\zeta)} \tag{30}$$

The continuous density function calculated with equations (19), (25), (27), (29) or (30) has to be transformed into a finite set of (possibly frequency dependent) coefficients corresponding to the each loudspeaker of the system. This can be done by applying a quadrature of the integral (7). The coefficient $a_l$ corresponding to the l-th loudspeaker is therefore computed as $$a_l=a(y_l)\Delta S_l \tag{31}$$

where $\Delta S_l$ has the dimension of an area and depends on the loudspeaker arrangement. If these are arranged regularly, then $$\Delta S_l=\frac{A_{\partial\Lambda}}{L} \tag{32}$$

where $A_{\partial\Lambda}$ is the area of the boundary $\partial\Lambda$ and L is the total number of loudspeakers of the system. If the boundary $\partial\Lambda$ is a sphere of radius $R_\Lambda$, then $$\Delta S_l = \frac{4\pi R_\Lambda^2}{L} \tag{33}$$

Numerical Solution of the Integral Equation

The second method to solve the integral equation (7) is numerical. As a first step, the boundaries $\partial\Lambda$ and $\partial V$ must be sampled. The sampling scheme adopted for $\partial\Lambda$ is given by the loudspeaker array: the boundary $\partial\Lambda$ is divided into L surfaces, each of them corresponding to a loudspeaker. The surface $\Delta S_l$ corresponding to the l-th loudspeaker is the same as in equations (31), (32) or (33). The boundary $\partial V$ is divided into Q surfaces. The q-th surface is identified by its geometrical centre $x_q$, hereafter called a sampling point. It is recommended that the number of sampling points is chosen to be such that Q>L. The sampling points should be chosen in such a way that the average distance $\delta x$ between two neighboring points is constant or approximately constant. In order to avoid problems arising from spatial aliasing, it is recommended that, for a given angular frequency $\omega$, $$\delta x < \frac{c\pi}{\omega} \tag{34}$$

In what follows, this relation is referred to as the aliasing condition. As will be discussed later, it might be desirable to choose a control volume V which is a function of the frequency.

In order to avoid the problems arising from the Dirichlet eigenvalues explained above, it can be useful to add some additional sampling points in the interior of V, thus increasing the number Q of sampling points. In the case of $\partial V$ being a sphere, it might be a wise choice to add an additional sampling point in the centre of the sphere, in order to avoid the problems arising from the first Dirichlet eigenvalue, whose characteristic wave number is identified by the first zero of the spherical Bessel function $j_0(kR_V)$. Another way of avoiding these problems is by choosing, for a given frequency $\hat{\omega}$, a control volume $V(\hat{\omega})$ for which the frequency considered does not correspond to one of its Dirichlet eigenvalues. Some possible strategies for choosing a frequency dependent control volume are described later.

The vector p is defined as the set of values of the target field p(x) evaluated at the positions of the sampling points. In the case that the target field is due to an omnidirectional point source located at z in the free field, as in the case of equation (26), then the q-th element of the vector p is defined as $$p_q = g(z \mid x_q) = \frac{e^{ikd_{qz}}}{4\pi d_{qz}} \tag{35}$$

where $d_{qz}=\|z-x_q\|$ is the distance between the q-th sampling point on $\partial V$ and the virtual source, and it can depend on the frequency if the control volume V also depends on the frequency. The dimension of p is Q. The operator S can be transformed into matrix s, which is defined as $$S_{ql} = g(y_l \mid x_q) = \frac{e^{ikd_{ql}}}{4\pi d_{ql}} \tag{36}$$

where $d_{ql}=\|y_l-x_q\|$ is the distance between the q-th sampling point on $\partial V$ and the position of the l-th loudspeaker. This distance can depend on the frequency if the control volume V also depends on the frequency. The dimension of S is therefore Q by L. The regularized pseudo inverse matrix $S^+$ (not to be confused with the adjoint operator) is defined as $$S^+=(S^H S+\beta I)^{-1} S^H \tag{37}$$

where $\beta$ is a regularization parameter and I is the identity matrix of dimension L by L. The dimension of $S^+$ is L by Q. It is important to emphasise that this matrix depends only on the loudspeaker arrangement and on the sampling scheme on the boundary of the control volume, and does not depend on the position of the virtual source. It is now possible to compute the coefficient $a_l$ corresponding to the l-th loudspeaker as $$a_l = \sum_{q=1}^{Q} S_{lq}^{+} p_q \tag{38}$$

It is important to notice that both matrices S and $S^+$ and the vector p depend on the wave vector k and hence on the operating frequency $\omega$.

A major feature of the two methods which have been presented for solving the integral equation (7) and to derive the loudspeaker coefficients $a_l$, is that they give identical results when the number of loudspeakers L tends to infinity.

It is now important to discuss how the control volume V can be modified depending on the operating frequency. For what has been said about the aliasing condition, it may seem to be wise to choose the control volume to be as small as possible. However, the study of the stability of the condition number of matrix S as a function of the operating frequency $\omega$ shows that if the control volume is too small, then the conditioning of the matrix S is poor.

In order to respect the sampling condition for all the considered frequencies and to have, at the same time, a well-conditioned matrix S, it might be desirable to choose a frequency dependent control volume $V(\omega)$. Suppose that, for a given frequency $\hat{\omega}$, a control volume $V(\hat{\omega})$ has been chosen which is a star-convex set and a set of sampling points $x_l(\hat{\omega})$ have been chosen which respect the sampling condition, which grants good conditioning of the matrix S and $\hat{\omega}$ does not correspond to one of the Dirichlet eigenvalues for $V(\hat{\omega})$. In this case it is possible to define a frequency dependent control volume $V(\omega)$, which has the same shape of $V(\hat{\omega})$ and which is identified by the sampling points $$x_l(\omega) = \frac{\omega}{\hat{\omega}} x_l(\hat{\omega}) \tag{39}$$

Provided that Q>L, a suitable choice for a frequency dependent control volume $V(\omega)$ is a sphere centered in the origin with radius $$R_V = \frac{c(\sqrt{L}-1)}{\omega} \tag{40}$$

The motivation of this choice is non trivial and is related to the behavior of the spherical Bessel functions. It has been shown that for spherical geometries the Bessel functions appear in the expression (21) of the singular values $\sigma_n$, and the radius $R_V$ of the control volume appears in the argument of these functions. It can be inferred that, even in the discrete case, the L eigenvalues of the squared matrix $S^HS$ are related to the spherical Bessel functions. The degeneracy of the eigenvalues $\sigma_n$ in the case of spherical geometries has also been discussed above. This implies that if $S^HS$ has dimension L by L and always in the case of spherical geometry, then it has ideally $N=\sqrt{L}-1$ independent eigenvalues. This approximation is exact when L tends to infinity and the boundaries $\partial V$ and $\partial\Lambda$ are sampled regularly. The condition number of $S^HS$ is related to the ratio between the largest and the smallest singular values, both related to the spherical Bessel functions. Using these arguments, it can be deduced that an optimal choice for the radius $R_V$ is given by $R_V=N/k$, which leads to equation (40).

In both cases of equation (39) and equation (40), the additional constraint must be applied that all loudspeakers and the virtual source position must be located outside of the control volume.

It is worth highlighting, once again, that the control volume does not correspond to the listening area, as an accurate reproduction of the target sound field can be achieved, because of analytical continuation, also in the exterior of the control volume.

If the target sound field is due to a point source located at z, it is useful to introduce the factor $$\Delta\Phi_{lz}=e^{ik(r_l-r_z)+i\omega\delta t} \tag{41}$$

This represents a simple phase compensation factor, which compensates for the delay arising in the filter computation caused by the difference of the radial co-ordinate of the l-th loudspeaker $r_l$ and of the virtual source $r_z$. The term $\delta t$ is a small constant quantity, corresponding to a modeling delay, which has been introduced in order to guarantee the causality of the digital filters.

DESCRIPTION OF POSSIBLE IMPLEMENTATIONS

Figure 3:
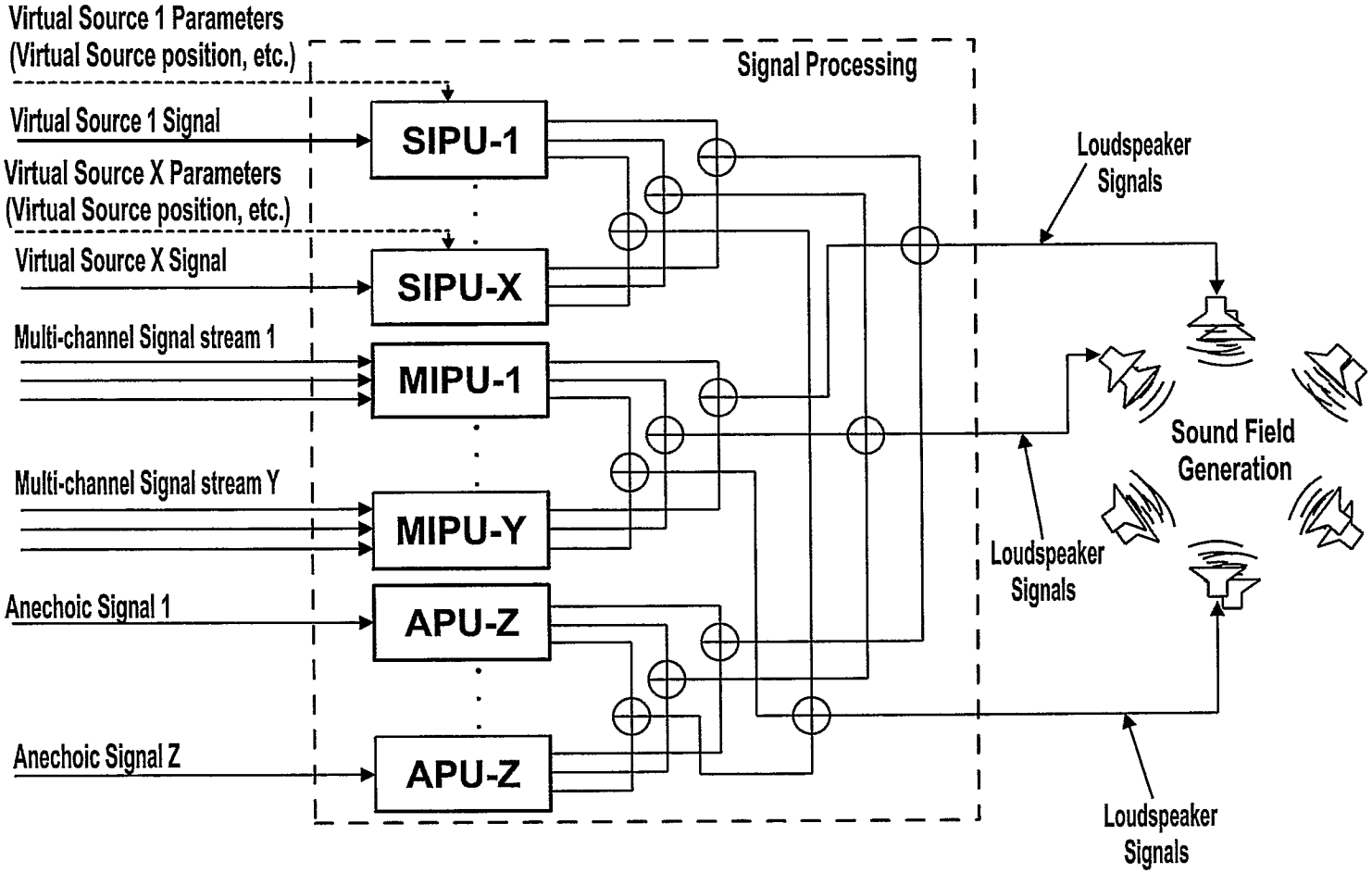
FIG. 3 is a schematic diagram showing various functional components of a sound reproduction system.

FIG. 3 reports a diagram of the signal processing apparatus of the sound reproduction system. The apparatus comprises functional modules, called Single Input Processing Units (SIPU), Multiple Input Processing Units (MIPU) and Auralisation Processing Units (APU). They are the signal processing units corresponding to the three different operational modes of the system described above. It will be appreciated that the limit on the total number of SIPU, MIPU and APU modules of the system is not given a priori and depends on the computational power of the electronic hardware used for the implementation of the system. The different modules are composed by different components, described in detail in what follows. Digital filters are one of these components. They are defined in what follows with mathematical expressions, and from these expressions digital Finite Impulse Response filters (or possibly Infinite Impulse Response Filters) can be easily designed using standard techniques, such as for example the frequency sampling method. The use of Finite Impulse Response filters is suggested, as the filters described in what follows usually show a strong decay in the time domain. It is also relevant to highlight that most of the components of the different modules, such as digital delays and filters, are often described as separate elements for sake of clarity. However, it can be useful implementing a series of one of more of these elements as a single digital filter. As an example, referring to FIG. 4, it is possible to implement the Low Pass Filter (LPF) and each of the filters in the low frequencies bus ($F_1$, $F_2$, etc.) as a single filter.

Single Input Processing Unit (SIPU)

Figure 4:
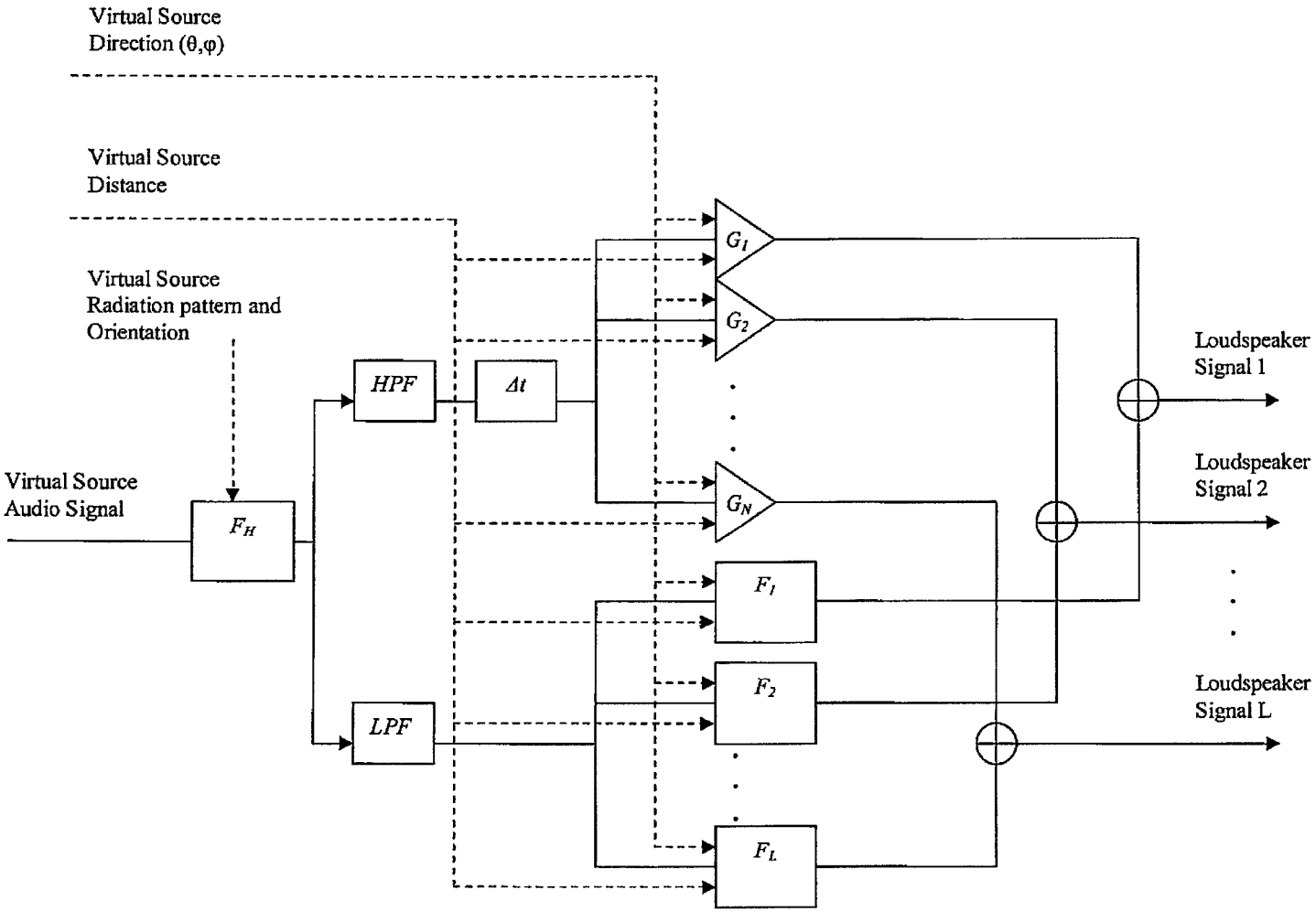
FIG. 4 is a block diagram of a single input processor arrangement.

FIG. 4 shows a block diagram of a Single Input Processing Unit. This module is designed to generate the L loudspeaker signals which allow the reproduction of the sound field due to a virtual source at a given position in the free field, with a given radiation pattern and with a given orientation. The SIPU receives as an input a single audio signal and some additional data, describing the location (distance and direction) of the virtual source, its radiation pattern and its orientation. With reference to FIG. 1, the distance of the virtual source $r_x$ is described by a scalar and positive number, while the direction of the virtual source is described by the two angles $\theta_x$ and $\phi_x$. The orientation of the virtual source is described by two angles and its radiation pattern by a complex function of the frequency and of two angles.

The audio signal is first filtered by the digital filter $F_H$, which is defined depending on the orientation and distance of the virtual source. The signal is then divided into two busses, called a high frequency bus and a low frequency bus respectively. A high pass filter HPF(ω) and a low pass filter LPF(ω) are applied to the two signals respectively. The two filters are such that $$LPF(\omega)+HPF(\omega)=e^{i\omega\Delta t}$$

This means that if one signal is filtered separately by the two filters and the two outputs are summed together, the result is a delayed version of the original signal. The cut-on frequency of the high pass filter (−6 dB) and the cut-off frequency of the low pass filter (−6 dB) is the same and is called $\omega_c$. The latter can be chosen to be the smallest frequency ω satisfying the condition $$\frac{|h_N^{(1)}(r_{lmin}\omega/c)|}{|h_0^{(1)}(r_{lmin}\omega/c)|} \approx 1$$

where $r_{lmin}$ is the smallest of all loudspeaker radial co-ordinates $r_l$, that is to say the radial co-ordinate of the loudspeaker whose position is the closest to the origin.

The signal on the high frequency bus and the signal on the low frequency bus are processed in different ways, applying a set of operation called High Frequency Signal Processing and Low Frequency Signal Processing, respectively. They are described in detail below.

It should be noted that the existence of both the High Frequency Bus and the Low Frequency Bus is not essential. For example, a variant of the Single Input Processing Unit may comprise either the High Frequency Signal Processing or the Low Frequency Signal Processing. In these special cases, it is clear that the High Pass Filter HPF(ω) and the Low Pass Filter LPF(ω) would need to be removed.

The signal on the low frequency bus is filtered in parallel by a bank of L digital filters, labeled $F_1, F_2, \ldots, F_L$ in FIG. 4. Each filter corresponds to a different loudspeaker. These filters can be defined in two different ways, called numerical filter computation and analytical filter computation, both depending on the position of the virtual source and on the position of the loudspeaker considered.

1—For the numerical filter computation, a control volume V is chosen as explained above. Its geometrical centre coincides with the origin of the co-ordinate system. As described above, a set of Q regularly arranged sampling points is defined on the control surface. The q-th sampling point is identified by the vector $x_q$. All loudspeakers and the location of the virtual source lie outside of the control volume. As has been discussed, the control volume and the sampling points can be chosen to be frequency dependent. A suitable choice for a frequency dependent control volume is a sphere with radius $$R_V = \min\left[\frac{c(\sqrt{L}-1)}{\omega},\ r_z,\ r_{lmin}\right]$$

As discussed above, it is beneficial to include some extra points in the interior of V in order to avoid problems arising from the Dirichlet eigenvalues. The frequency dependent vector p(ω) is defined as in equation (35). The frequency dependent matrices S(ω) and $S^+(\omega)$ are defined as in equations (36) and (37). It is important to highlight that these matrices depend only on the loudspeaker arrangement and on the sampling scheme of the boundary of the reconstruction area, and do not depend on the position of the virtual source. For this reason, they can be computed off-line and not in real time. The digital filter corresponding to the l-th loudspeaker is computed from $$F_l(\omega) = \Delta\Phi_{lz}(\omega)\sum_{q=1}^{Q} S_{lq}^{+}(\omega)p_q(\omega)$$

2—The digital filters in FIG. 4, when they are computed following the analytical approach, have a frequency dependence of the form $$F_l(\omega) = \Delta S_l(\omega)\Delta\Phi_{lz}(\omega)\sum_{n=1}^{L}\frac{a_n(y_l,\omega)}{\sigma_n(\omega)+\beta(\omega)}\int_{\partial V(\omega)} g(z\,|\,x,\omega)p_n(x,\omega) * dS(x,\omega)$$

where the functions $a_n(y,\omega)$ and $p_n(x,\omega)$ and the singular values $\sigma_n(\omega)$, defined by equations (12) and (15), are computed analytically as described previously. ∂V(ω) is the boundary of the control volume and β(ω) is a regularization parameter; both can be chosen to be frequency dependent. It is recommended to choose the order N of truncation of the series to be equal to (or possibly smaller than) the number of loudspeakers L. In the case when the loudspeakers are regularly arranged on a sphere with radius $R_\Lambda$ and the control volume is also a sphere with radius $R_V$, then following equation (27) the frequency response of the digital filter corresponding to the l-th loudspeaker is defined by $$F_l(\omega) = \Delta\Phi_{lz}(\omega)\sum_{n=0}^{M}\frac{h_n^{(1)}(kr_z)}{h_n^{(1)}(kR_\Lambda)}\frac{2n+1}{L}P_n(\cos(\zeta))$$

where cos(ζ) is defined by equation (28) and the order M of truncation of the series must be a natural number and is chosen to be $$M \le \sqrt{L}-1$$

The signal on the high frequency bus is first delayed by an amount of time Δt that takes in consideration the length of the digital filters in the low frequencies bus and the quantity δt introduced in equation (41). The signal is then multiplied by a bank of parallel gains, each of them corresponding to a different loudspeaker. They are labeled $G_1, G_2, \ldots, G_L$ in FIG. 4. There are two possible ways of defining these gains. The first method is derived from equation (29), corresponding to the high frequency approximation of equation (27). The gain corresponding to the l-th loudspeaker is defined as $$G_l = \begin{cases} \dfrac{r_l(N+1)}{r_z}\dfrac{P_M(\cos(\zeta_l)) - P_{M+1}(\cos(\zeta_l))}{1-\cos(\zeta_l)}\dfrac{\Delta S_l}{r_l^2} & \text{if } \zeta_l < \zeta_M \\ 0 & \text{if } \zeta_l \ge \zeta_M \end{cases}$$

cos(ζ) is defined by equation (28). M depends upon the average distance of the neighboring loudspeakers and for a regular arrangement can be chose as $M \le \sqrt{L}-1$. In the case when the loudspeakers are regularly arranged on the surface of a sphere, then $\Delta S_l/r_l^2 = 1/L$. The angle $\zeta_M$ defines the semi-aperture of the main lobe of the function $(P_M(\cos(\zeta)) - P_{M+1}(\cos(\zeta)))/(1-\cos(\zeta))$ and can be defined by the relation $$P_M(\cos(\zeta_M)) + P_{M+1}(\cos(\zeta_M)) = \min[P_M(\cos(\zeta)) + P_{M+1}(\cos(\zeta))]$$

This implies that only the loudspeakers which are closest to the location of the virtual source are active, and that they all operate in-phase.

The second method is derived from the assumption that the digital filters on the low frequency bus designed with the numerical approach and corresponding to the loudspeakers which are closer to the location of the virtual source show an asymptotic behavior at high frequencies. It is supposed that after the cut-off frequency $\omega_c$ the magnitude of these filters remains constant and the phase is very close to 0. The gain corresponding to the l-th loudspeaker is therefore defined as $$G_l = \begin{cases} \left|\sum_{k=1}^{K} S_{lk}^{+}(\omega_c)p_k(\omega_c)\right| & \text{if } \zeta_l < \zeta_M \\ 0 & \text{if } \zeta_l \ge \zeta_M \end{cases}$$

where the angle $\zeta_M$, the matrix $S^+(\omega)$ and the vector p(ω) are defined as above.

Microphone Array and Multiple Input Processing Unit (MIPU)

The Multiple Input Processing Unit is designed to generate the L loudspeaker signals which allow the reproduction of a sound field which has been captured using a specially designed array of microphones.

The array of microphones is designed in connection with the reproduction system, meaning that the microphone array is to be considered as a part of the whole system. The microphone array comprises a plurality of omnidirectional capsules regularly arranged on multiple surfaces. It will be appreciated that a microphone capsule relates to a portion where a microphone membrane is located. These surfaces define the boundaries of multiple, concentric control volumes. The choice of multiple control volumes arise from the fact that for a given number of sampling points the ideal size of the control volume, which respects the aliasing condition and allow a good conditioning of matrix $S(\omega)$, depends on the considered frequency. It is not practicable to choose a control volume which changes continuously as a function of the frequency. It is however possible to choose a finite number of control volumes $V_1, V_2 \ldots V_F$, each of them dedicated to a given frequency range. A set of $Q_f$ omnidirectional microphones are regularly arranged on the boundary $\partial V_f$ of the control volume $V_f$. The set of all the microphones arranged on the same control volume is referred to as a microphone layer. The total number of microphones Q is given by $$Q = \sum_{f=1}^{F} Q_f$$

As explained above, problems can arise at those frequencies, which correspond to the Dirichlet eigenvalues of the control volume. The use of a multiple microphone layer can partially overcome this problem, but it can happen that one of the frequencies corresponding to one of the Dirichlet eigenvalues of the volume $V_f$ belongs to the range of frequencies to which that control volume is dedicated. This problem can be partially, when not totally, overcome by adding one or more microphones in the interior of the control volume. A wise choice for an additional microphone location is in the centre of the microphone array, especially when the control volumes are spherical. This is due to the fact that the first critical frequency for a given volume $V_f$ is identified by the first zero of the spherical Bessel function $j_0(R_f\omega/c)$. In physical terms this means that the microphone array can not detect the component of the sound field corresponding to the zero order spherical harmonic. The microphone in the centre of the array can, on the contrary, detect only that missing component, thus overcoming the problem. A higher number of additional microphones might be needed for higher critical frequencies. It is also possible to use, as an additional sampling point for a given layer $\partial V_f$, one of the microphones arranged on a different layer $f' \neq f$.

A suitable choice for the different control volumes is given by a set of concentric spheres. As a guideline for the choice of the radius of these spheres, if the upper frequency for the operating frequency range of the control volume $V_f$ is $\omega_f$, the radius $R_f$ of that control volume can be chosen to be $$R_f = \frac{c\left(\sqrt{\min_{LQf}} - 1\right)}{\omega_f}$$

where $\min_{LQf}$ is the smallest number between the number of loudspeakers L and the number of $Q_f$ of microphones on that layer. This guideline arises from considerations of the spherical Bessel functions and on the conditioning of matrix $S^H S$, which have been discussed above (refer to equation (40)). This approach suggests that it is also possible to split a given frequency range corresponding to a control volume $V_f$ with $Q_f$ microphones into two sub-ranges by simply reducing the number of microphones used in the processing of the lower frequency range. This can be especially useful at very low frequencies, where the choice of radius discussed above would result in a very large value. As an example, consider a system composed by forty loudspeakers and a layer of thirty six microphones regularly arranged on the sphere $\partial V_f$ dedicated to the audio frequencies below 500 Hz. Following the above guideline, the radius $R_f$ is approximately 0.5 m. It is possible to choose a subset of eight microphones on that layer and define an additional frequency range with higher limit of approximately 200 Hz.

A microphone array with just one layer can be considered as a special case of the microphone array described. Another variant is constituted by a microphone array having a scattering object (as for example a rigid sphere) in the region of the space contained inside the smallest control volume. The filter computation described in what follows remains the same. It is also straightforward to perform the analytical calculation of the digital filters described later for the case corresponding to a set of microphones arranged around or on the surface of a rigid sphere.

Figure 5:
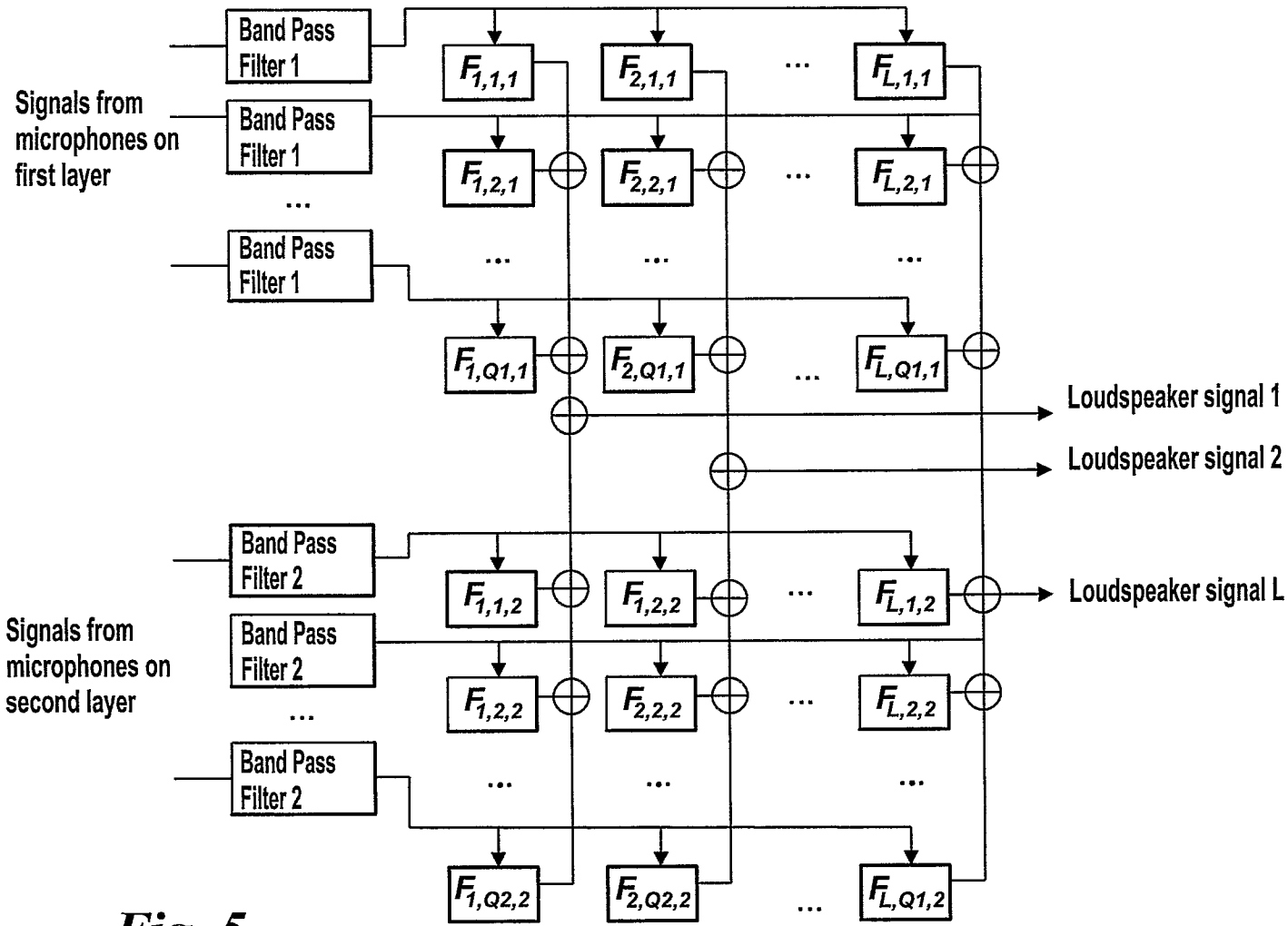
FIG. 5 is a block diagram of a multiple input processor arrangement.

The output signals from the microphone array are processed by the Multiple Input Processing Unit, represented by FIG. 5. This figure illustrates the example corresponding to a microphone array with only two layers, but this approach can be identically extended to configurations with more microphone layers. The output signals of each layer are processed separately, as shown in the figure. As a first step, each signal is filtered through a Band Pass Filter ($BPF_f(\omega)$) whose cut-on and cut-off frequencies are defined by the frequency range corresponding to that microphone layer. For the layer $f$, the cut-on frequency is $\omega_{f-1}$ and the cut-off frequency is $\omega_f$. These band pass filters must respect the condition $$\sum_{f=1}^{F} BPF_f(\omega) = e^{i\omega\Delta t}$$

analogous to the Low and High Pass Filters in the SIPU. The signals are then process by a matrix of digital filters, labeled $F_{1,1,1}, F_{L,1,1}, \ldots, F_{L,Q11}$, in FIG. 5. These filters can be defined in three different ways: analytically, numerically or with measurements. All these formulation are grounded on the same theoretical background, which has been discussed above.

1—Using a purely numerical approach, the filters corresponds to the elements of the frequency dependent matrix $S^+(\omega)$ defined by equation (37). The filter corresponding to the l-th loudspeaker and the q-th microphone on the layer $f$ is computed from $$F_{l,q,f}(\omega) = e^{i\omega\delta t} S^+_{lq}(\omega)$$

where the small $\delta t$ has been introduced in order to ensure that the filter is causal (when this is needed).

2.—The filters can be also calculated after having measured, possibly in an anechoic environment, the impulse response between each loudspeaker and each microphone on the given layer. The measurement can be carried out using standard techniques (swept sine, MLS, etc.) and is subject to the well-known sources of error that affect these kinds of measurements. The microphone array must be arranged in such a way that its geometrical centre corresponds to the origin of the co-ordinate system. It is preferable to exclude reflections generated by the surrounding environment in the measurement. This can be done by carrying out the measurements in an anechoic environment or by windowing the measured impulse response in order to take into account only the initial part of the measured signal. The acquired impulse responses need to be transformed in the frequency domain by applying a Fourier transform. The set of acquired measurements constitutes the matrix $H(\omega)$. Its element $H_{qlf}(\omega)$ represents the transfer function between the l-th loudspeaker and the q-th microphone on the layer $f$. Following a procedure analogous to equation (37), matrix $H^{+}(\omega)$ is computed from $$H^{+}(\omega)=(H^{H}(\omega)H(\omega)+\beta(\omega)I)^{-1}H^{H}(\omega)$$

where the elements $\beta(\omega)$ and I are defined as for equation (37). It is very important to apply a regularization scheme to the inversion of matrix $H^{H}(\omega)H(\omega)$, as the presence of measurement errors can result in the computation of unstable filters. In the proposed approach, Tikhonov regularization with frequency dependent regularization parameter $\beta(\omega)$ is suggested. The filter corresponding to the l-th loudspeaker and the q-th microphone on the layer $f$ is computed from $$F_{l,q,f}(\omega)=e^{i\omega\delta t}H^{+}_{lqf}(\omega)$$

where $\delta t$ is as defined above.

3—An analytical computation method for the filters can be derived from discretising, in equation (19), the integral $\langle p_n|p\rangle$ defined by equation (8). Equation (19) can therefore be reformulated as $$a_f(y)=\sum_{q=1}^{Q}p(x_q)\Delta S'_q\sum_{n=1}^{M}\frac{1}{\sigma_{n,f}}p_{n,f}(x_q)a_{n,f}(y)$$

where $\Delta S'_q$, analogous to the coefficient where $\Delta S_l$ described above, has the dimension of an area and depends on the microphone arrangement on the given layer. The order of truncation $M=\min_{LQf}$ is the smallest number between the number of loudspeakers L and the number of $Q_f$ of microphones on the layer $f$. The subscript index $[\bullet]_f$ is due to the relevant fact that, in general cases, the eigenfunctions and eigenvalues $p_{n,f}(x)$ $a_{n,f}(y)$ and $\sigma_{n,f}$ can be different for different layers. Considering finally equation (31) the frequency response of the filter corresponding to the l-th loudspeaker and the q-th microphone on the layer considered is therefore defined by $$F_{l,q,f}(\omega)=e^{i\omega\delta t}\Delta S_l\Delta S'_q\sum_{n=1}^{M}\frac{p_{n,f}(x_q,\omega)a_{n,f}(y_l,\omega)}{\sigma_{n,f}(\omega)+\beta(\omega)}$$

In the special case when both the loudspeakers and the microphones on the considered layer are regularly arranged on two spheres of radius $R_\Lambda$ and $R_f$, respectively, the filter is computed from $$F_{l,q,f}(\omega)=e^{i\omega\delta t}\frac{4\pi}{LQ_f}\sum_{n=1}^{M'}\frac{(2n+1)P_n(\cos(\zeta_{lq}))}{jkj_n(kR_f)h_n^{(1)}(kR_\Lambda)+\beta(\omega)}$$

where equations (21), (33), (A2) and (A3) have been used and $\cos(\zeta_{lq})$ is the cosine of the angle between the vectors identifying the locations of the microphone and of the loudspeaker considered (refer to equation (28)). The order of truncation M' is chosen to be $$M'\leq\sqrt{\min_{LQf}}-1$$

The outputs of the digital filters are finally combined as shown in FIG. 5.

Auralisation Processing Unit (APU)

Figure 6:
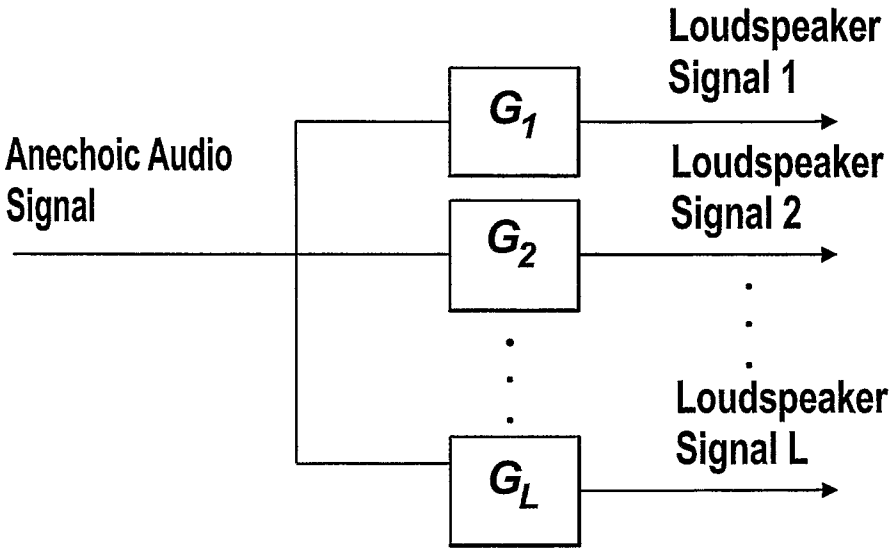
FIG. 6 is a block diagram of auralisation processor arrangement.
Figure 7D:
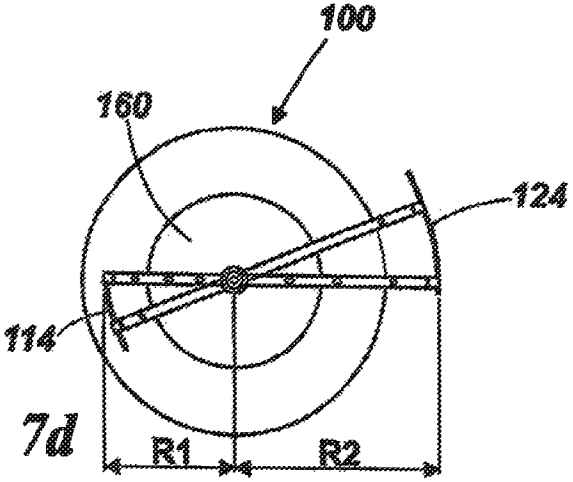
FIG. 7*d* is a plan view of microphone array of FIGS. 7*a* and 7*b*
Figure 7A:
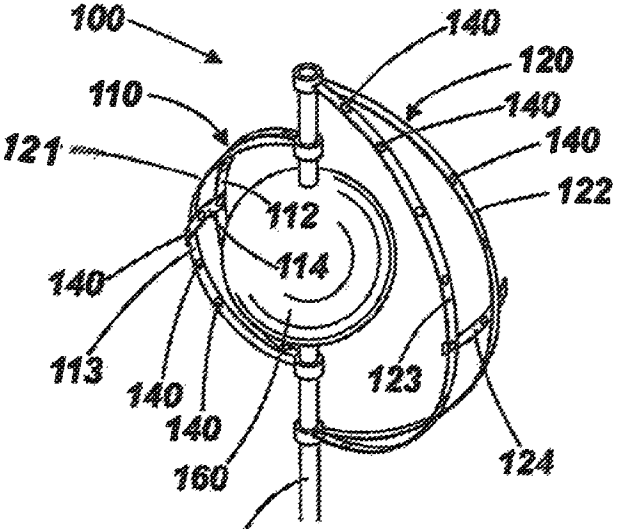
FIGS. 7*a* and 7*b* are perspective views of a microphone array.
Figure 7C:
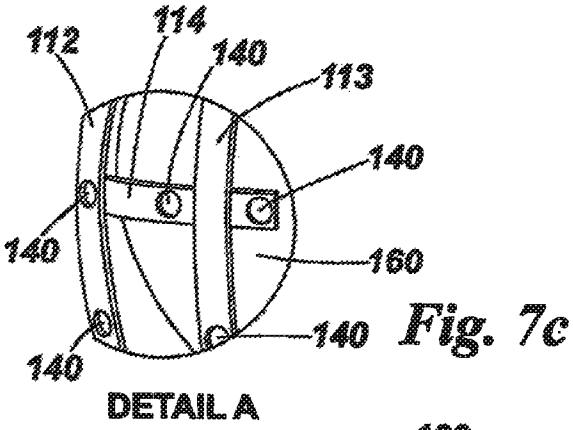
FIG. 7*c* is a detailed view of part of the microphone array of FIGS. 7*a* and 7*b*.
Figure 7B:
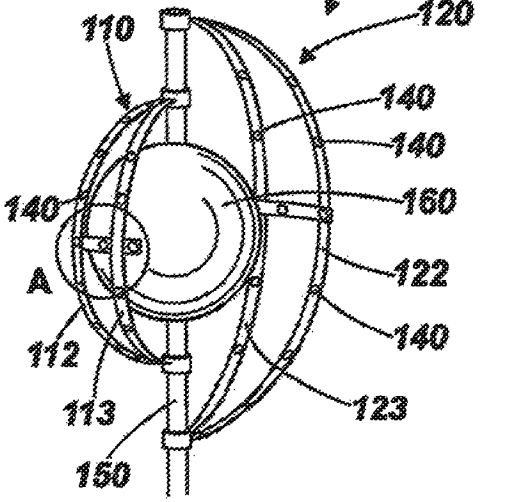

FIG. 6 reports a block diagram of the Auralisation Processing Unit. This module is designed to generate the L loudspeaker signals which allow the reproduction of the sound field due to a point source located at a given position in a given reverberant environment, such as a concert hall or an enclosure. The digital filters labeled $G_1, G_2, \ldots, G_L$ in FIG. 6 are computed by combining the filters of the Multiple Input Processing Unit with a set of impulse responses describing the reverberant field of the reverberant environment considered. These impulse responses are the impulse responses measured between a reference source (for example a loudspeaker or an omnidirectional source) and the microphone array 100 described above. Both the reference source and the microphone array are located in the reverberant environment considered and the measurements can be carried out using one of the conventional standard techniques mentioned above. The set of Q measured impulse responses are transformed in the frequency domain by applying a Fourier transform, and are labeled $R_1, R_2, \ldots, R_Q$. The filter corresponding to the l-th loudspeaker is computed from $$G_l(\omega)=\sum_{q=1}^{Q}R_q(\omega)F_{l,q,f}(\omega)BPF_{f(q)}(\omega)$$

where the filters $F_{l,q,f}(\omega)$ are defined in the same way as for the MIPU. The Band Pass Filter $BPF_{f(q)}(\omega)$ depends on the layer on which the q-th microphone is arranged.

When designing a Finite Impulse Response filter from the formulation of $G_l(\omega)$ given above, it is important to consider that while the filters $F_{l,q,f}(\omega)$ and $BPF_{f(q)}(\omega)$ are in general short in the time domain, the impulse responses $R_q(\omega)$ are in general very long, their length depending on the reverberation time of the measured reverberant environment. This factor is vital when defining the filter length, which must be the same if the filters are defined in the frequency domain. In order to avoid this difficulty it is also possible to define the filters in the time domain as $$G_l(t)=\sum_{q=1}^{Q}\mathfrak{I}^{-1}[R_q(\omega)]\otimes\mathfrak{I}^{-1}[F_{l,q}(\omega)BPF_{f(q)}(\omega)]$$

where the operator $\mathfrak{I}^{-1}[\bullet]$ represents the inverse Fourier transform and the symbol $\otimes$ represents a convolution in the time domain.

The Auralisation Processing Unit shares some strong conceptual similarities with the Multiple Input Processing Unit, but while the input to the latter is a stream of Q audio channels which are processed by a matrix of Q by L by F digital filters, the input to the APU is a single audio signal, processed by a bank of L filters. The latter are computed from set of measurements, but their computation can be made off-line. This implies that the real time implementation of an MIPU is much more computationally expensive than that of an APU.

APPENDIX

Spherical Harmonic Expansion of the Free Field Green Function $$\frac{e^{ik|x-y|}}{4\pi|x-y|} = \sum_{n=0}^{\infty} ikh_n^{(1)}(k|y|)j_n(k|x|)\sum_{m=-n}^{n} Y_n^m(\theta_x\phi_x)Y_n^m(\theta_y,\phi_y)^* \tag{A1}$$

Finite Summation of Legendre Polynomials $$\sum_{n=0}^{N}(2n+1)P_n(x) = (N+1)\frac{P_N(x)-P_{N+1}(x)}{1-x} \tag{A2}$$

Summation Formula for the Spherical Harmonics $$\sum_{m=-n}^{n} Y_n^m(\theta,\phi)Y_n^m(\theta',\phi')^* = \frac{2n+1}{4\pi}P_n(\cos(\zeta)) \tag{A3}$$

where $P_n(\bullet)$ is the Legendre polynomial of degree n and $\zeta$ is the angle between the directions identified by $\theta,\phi$ and $\theta',\phi'$. It holds that $$\cos(\zeta)=\cos(\phi)\sin(\theta)\cos(\phi')\sin(\theta')+\sin(\phi)\sin(\theta)\sin(\phi')\sin(\theta')+\cos(\theta)\cos(\theta')=\sin(\theta)\sin(\theta')\cos(\phi-\phi')+\cos(\theta)\cos(\theta') \tag{A4}$$

Orthogonality of the Spherical Harmonics $$\int_0^{2\pi}d\phi\int_0^{\pi}Y_n^m(\theta,\phi)Y_{n'}^{m'}(\theta,\phi)^*\sin(\theta)d\theta=\delta_{nn'}\delta_{mm'} \tag{A5}$$

Completeness Relation of the Spherical Harmonics $$\sum_{n=0}^{\infty}\sum_{m=-n}^{n} Y_n^m(\theta,\phi)Y_n^m(\theta',\phi')^* = \delta(\phi-\phi')\delta(\cos(\theta)-\cos(\theta')) \tag{A6}$$

Large Argument Approximation of Spherical Hankel Functions ($x\rightarrow\infty$)

$$h_n^{(1)}(x) \approx (-i)^{n+1}\frac{e^{ix}}{x} \tag{A7}$$

The invention claimed is:

1. A method of determining control signal data for an array of loudspeakers, the control signal data being such as to control the loudspeakers to produce a desired sound field associated with an audio signal, the method comprising:

determining control signal data for different frequency components of a desired sound field in respect of respective different positions in a listening volume of a loudspeaker array;

wherein, for each of the different frequency components, determination of the control signal data includes virtual sampling of the desired sound field at the surface of a frequency dependent virtual control volume (V); and wherein the size of the control volume (V) is dependent on the frequency component being sampled such that a larger control volume (V) is used for lower frequency components and a smaller volume is used for higher frequency components.

2. The method of claim 1 wherein different sizes of the control volume (V) are used for different frequency bands.

3. The method of claim 1 wherein different sizes of the control volume (V) are of substantially the same shape.

4. The method of claim 1 wherein the different positions define sampling points and wherein substantially the same number of sampling points is used for different sizes of the control volume (V).

5. The method of claim 1 wherein the average distance between sampling points is less than half the wavelength considered.

6. The method of claim 1, further comprising sampling the desired sound field internally of the control volume (V).

7. The method of claim 6 wherein sampling internally of the control volume (V) is effected at those frequencies which correspond to Dirichlet eigenvalues of the control volume.

8. The method of claim 6 wherein a sample internally of the control volume (V) is taken at the geometric centre of the control volume.

9. The method of claim 1 wherein determining the control signal data includes determining the control signal data such that only a loudspeaker, of the loudspeaker array, closest to a virtual source generated by the loudspeaker array is activated.

10. The method of claim 9 wherein determination of the control signal data is used for high frequency component signal processing.

11. The method of claim 1 wherein, in addition to an input audio signal, data indicative of location, radiation pattern and orientation of a virtual source, generated by the loudspeaker array, are used to determine the control signal data.

12. The method of claim 11 wherein the audio signal comprises a signal representative of the sound of an acoustic source and a signal representative of characteristic data of an acoustic environment.

13. The method of claim 12 wherein the sound of the acoustic source and the data of the acoustic environment are included in a signal obtained by sampling the acoustic source in the acoustic environment.

14. The method of claim 12 wherein the sound of the acoustic source and the data of the acoustic environment are separate signals.

15. A sound reproduction apparatus for processing an audio signal, comprising:

a microphone array for obtaining an audio signal; and a signal processor arranged to process the audio signal and to output control signal data for an array of loudspeakers to produce a desired sound field associated with the audio signal;

wherein the signal processor is configured to determine the control signal data for different frequency components of the desired sound field in respect of respective different positions in a listening volume of the loudspeaker array;

wherein, for each of the different frequency components, determination of the control signal data comprises virtual sampling of the desired sound field at the surface of a frequency dependent virtual control volume (V); and wherein the size of the control volume (V) is dependent on the frequency component being sampled such that a larger control volume (V) is used for lower frequency components and a smaller volume is used for higher frequency components.

16. The apparatus of claim 15 wherein the signal processor includes one or more impulse response filters arranged to process the audio signal and output the control signal data.

17. The apparatus of claim 15 wherein the microphone array includes a plurality of microphones, each at a different distance from the centre of the array.

18. A method for processing an audio signal to produce a desired sound field via an array of loudspeakers, comprising:

distinguishing different frequency components of a desired sound field;

determining control signal data for each of the different frequent frequency components of the desired sound field in respect of different positions in a listening volume of a loudspeaker array by virtual sampling of the desired sound field at the surface of a frequency dependent virtual control volume (V), the size of the control volume (V) is dependent on the frequency component being sampled such that a larger control volume (V) is used for lower frequency components and a smaller volume is used for higher frequency components; and outputting the control signal data to the array of loudspeakers.

* * * * *